United States Patent [19]

Satoh

[11] Patent Number: 5,052,538

[45] Date of Patent: Oct. 1, 1991

[54] COIN HANDLING APPARATUS

[75] Inventor: Naoto Satoh, Maebashi, Japan

[73] Assignee: Sanden Corporation, Gunma, Japan

[21] Appl. No.: 490,544

[22] Filed: Mar. 5, 1990

Related U.S. Application Data

[63] Continuation of Ser. No. 250,154, Sep. 28, 1988, abandoned.

[30] Foreign Application Priority Data

Oct. 1, 1987 [JP] Japan ..... 62-149225[U]
Oct. 12, 1987 [JP] Japan ..... 62-154712[U]

[51] Int. Cl.[5] ..... G07D 3/00; G07D 5/08

[52] U.S. Cl. ..... 194/317; 453/3; 453/17

[58] Field of Search ..... 194/317, 318, 319, 334, 194/338; 453/3, 5, 9, 15, 17

[56] References Cited

U.S. PATENT DOCUMENTS

| | | | |
|---|---|---|---|
| 2,648,417 | 8/1953 | Childers | 194/254 |
| 3,260,338 | 7/1966 | La Barge | 194/246 |
| 4,234,072 | 11/1980 | Prumm . | |
| 4,286,703 | 9/1981 | Schuller et al. | 453/9 X |
| 4,376,480 | 3/1983 | Abe | 194/323 |
| 4,625,851 | 12/1986 | Johnson et al. | 194/200 |
| 4,629,051 | 12/1986 | Abe | 194/261 |

FOREIGN PATENT DOCUMENTS

| | | |
|---|---|---|
| 0028656 | 12/1980 | European Pat. Off. . |
| 52-043497 | 5/1977 | Japan . |
| 59-40968 | 3/1984 | Japan . |
| 60-044162 | 3/1985 | Japan . |
| 61-237190 | 10/1986 | Japan . |
| 518630 | 3/1940 | United Kingdom . |
| 2122402 | 1/1984 | United Kingdom . |

*Primary Examiner*—F. J. Bartuska
*Attorney, Agent, or Firm*—Banner, Birch, McKie & Beckett

[57] ABSTRACT

A coin handling apparatus having a coin discriminating mechanism and a plurality of coin retaining mechanisms wherein at least one of coin outlets is disposed on a side surface of the coin discriminating mechanism. Since the number of coin outlets disposed on the bottom surface of the coin discriminating mechanism is thereby decreased, the width of the coin discriminating mechanism can be decreased. Additionally, the space provided by the decrease of the size can be used as a space for extending an auxiliary coin retaining mechanism, thereby increasing the space in the apparatus for retained change.

15 Claims, 6 Drawing Sheets

COIN HANDLING APPARATUS

This application is a continuation of application Ser. No. 07/250,154, filed Sept. 28, 1988 now abandoned.

BACKGROUND OF THE INVENTION

1. Field of the Invention

The present invention relates to coin handling apparatuses which can be built into vending machines and so forth, and which discriminate between deposited coins and retain acceptable coins.

2. Description of the Prior Art

A conventional coin handling apparatus is constructed of, for example, a coin discriminating device 1, a plurality of coin retaining tubes 2, 3, 4 and 5 and auxiliary coin retaining tubes 6 and 7 as shown in FIGS. 6, 7A and 7B (as disclosed for example in Japanese Utility Model Publication SHO 60-44162). Coin discriminating device 1 has a coin inlet 8 at the upper portion thereof and a plurality of coin outlets 2*a*, 3*a*, 4*a* and 5*a* and a coin outlet 9 for unacceptable coins (for example, metal slugs or foreign coins) on the bottom surface thereof. In the coin discriminating device 1, coin validation coils 10 determine the authenticity and type of the deposited coins. Coin chute 11 constitutes a coin path for the deposited coins and distrubuting gates 13, 14 and 15 distribute the coins according to their type as determined by the coin validation coils. Coin retaining tubes 2, 3, 4 and 5 retain, for example, ten monetary unit (such as yen or cents, e.g. a dime) coins 16, fifty unit coins 17, one hundred unit coins 18 and five hundred unit coins 19, respectively, and auxiliary coin retaining tubes 6 and 7 can hold a large number of coins for providing change to the customer.

As shown in FIG. 7A, a coin deposited into coin inlet 8 is tested by coin validation coils 10 to determine its authenticity and type during its passage through coin chute 11, and an unacceptable coin (a rejected coin) is returned through coin outlet 9 to a return opening (not shown). An acceptable coin is distributed to a corresponding coin path by distributing gates 13, 14 and 15 and then passes through one of coin outlets 2*a*, 3*a*, 4*a* and 5*a* and falls into one of coin retaining tubes 2, 3, 4 and 5.

In such a conventional apparatus, however, since all of coin outlets 2*a*, 3*a*, 4*a* and 5*a* and the rejected coin outlet 9 are arranged on the bottom surface of coin discriminating device 1, the width $W_1$ of the coin discriminating device cannot be significantly decreased. Although it might seem possible to arrange the coin outlets in two lines on the bottom surface in order to decrease the width $W_1$, in such case it is technically difficult to position the coin paths from distributing gates 13, 14 and 15 to coin outlets 2*a*, 3*a*, 4*a* and 5*a* without interfering with each other in discriminating device 1 and also to position coin paths from the coin outlets to coin retaining tubes 2, 3, 4 and 5 without interfering with each other.

One such coin handling apparatus has an overflow switching mechanism switching a coin path communicating with a coin retaining tube to an overflow coin path communicating with a cash box when the coin retaining tube is filled with coins. For example, JP-A-61-237190 and JP-A-52-43497 disclose such a type of coin handling apparatus, and each of the apparatuses disclosed in these publications has a coin discriminating device at the upper portion thereof and coin retaining tubes at the lower portion thereof.

The apparatus disclosed in the former publication has four gates as coin distributing means, and a deposited coin is distributed to a rejected coin path, one of the acceptable coin paths or an overflow coin path communicating with a cash box by operation of the four gates according to the combination of the opening or closing of the gates. The apparatus disclosed in the latter publication has three gates distributing unacceptable coins and acceptable coins and overflow sensors attached to the respective coin retaining tubes. When one of the coin retaining tubes is filled with coins, the overflow sensor detects this condition and the coin path to the coin retaining tube is switched by the operation of the gates to a coin path communicating with a cash box.

In the apparatus disclosed in JP-A-61-237190, however, since four gates and four solenoids driving the gates are required and the distributing means distributing the overflow coins to the overflow coin path communicating with a cash box is disposed in the coins discriminating device, there is a limit to which the width of the coin discriminating device can be decreased. In the apparatus disclosed in JP-A-52-43497, since the gate distributing the overflow coins to the overflow path communicating with a cash box is provided in the coin discriminating device and the coin path downstream of the above distributing gate is also formed in the coin discriminating device, there is also unsatisfactory limit to which the width of the coin discriminating device can be decreased.

SUMMARY OF THE INVENTION

Accordingly, an object of the present invention is to provide a coin handling apparatus which can be made smaller, and particularly narrower, thereby permitting an increase in the capacity of the coin retaining means and the number of coins which can be retained.

To accomplish this object, a coin handling apparatus according to the present invention is provided comprising a coin discriminating means at an upper portion of the coin handling apparatus, the coin discriminating means having a coin testing means for determining the type of the deposited coin, a distributing means for distributing a deposited coin to a destination according to its type as determined by the coin testing means, a plurality of coin outlets to which the coins distributed by the distributing means are guided, and a plurality of coin retaining means at a lower portion of the coin handling apparatus. Each of the coin retaining means communicates with a corresponding one of the coins outlets. Each of the coin retaining means retains therein the coin accepted by the coin discriminating means in accordance with its type. At least one of the plurality of coin outlets is disposed on a side surface of the coin discriminating means.

The coin handling apparatus can further include a switching means which switches a coin path communicating with one of the coin retaining means to an overflow path communciating with a cash box when the number of coins retained in the coin retaining means reaches a predetermined number. In such case the overflow path extending from the distributing means is preferably the same as path for the largest coins, and leads to another distributing means which distributes the largest coins to a coin path communicating with the coin retaining means for the largest coins, and overflow coins to a coin path communicating with the cash box.

This further distributing means is provided on the common path at a position outside of the coin distributing means.

Since a specific type of coin among the coins tested by the coin discriminating means is led to a coin retaining means through the coin outlet disposed on the side surface of the coin discriminating means, the number of the coin outlets on the bottom surface of the coin discriminating means, as compared with that of the conventional apparatus, can be decreased by the number of coin outlets disposed on the side surface. As a result, the coin discriminating means can be made narrower. Space can thereby be saved by making the coin discriminating means smaller, and if an auxiliary coin retaining means is extended into this space, the capacity of the retaining means for change can be increased.

In the coin handling apparatus wherein overflow coins are sent to a cash box, a special overflow path in the coin discriminating means need not be provided since the overflow path can be made coincident with the coin path for the largest coin. The size of the coin discriminating means itself can thereby be decreased. Moreover, the size can be further decreased by positioning a distributing means for distributing the largest coin and the overflow coin on the common path positioned outside of the coin discriminating means. As a result, space can also be saved in this type of coin handling apparatus and an auxiliary coin retaining means can extend into this space.

BRIEF DESCRIPTION OF THE DRAWINGS

Some preferred exemplary embodiments of the invention will now be described with reference to the accompanying drawings which are given by way of example only, and thus are not intended to limit the present invention.

FIG. 2 2A is an elavational view of a coin discriminating means of the apparatus shown in FIG. 1 showing the inside mechanism of the coin discriminating means.

DETAILED DESCRIPTION OF PREFERRED EMBODIMENTS OF THE INVENTION

Figure 1:
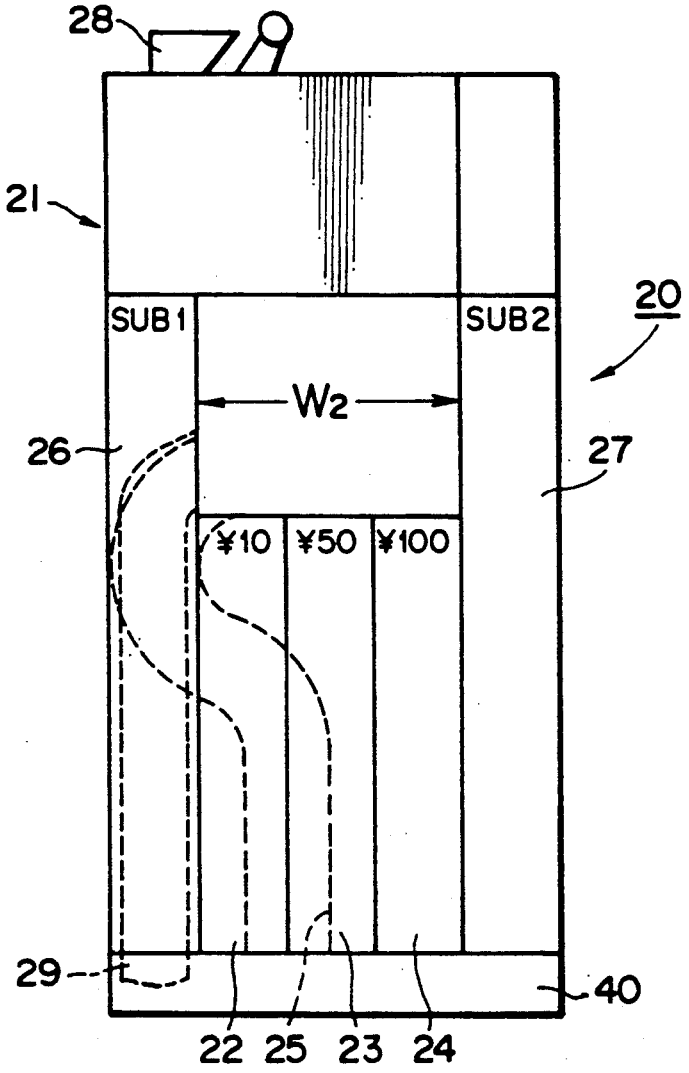
FIG. 1 is an elevational view of a coin handling apparatus according to a first embodiment of the present invention.
Figure 2B:
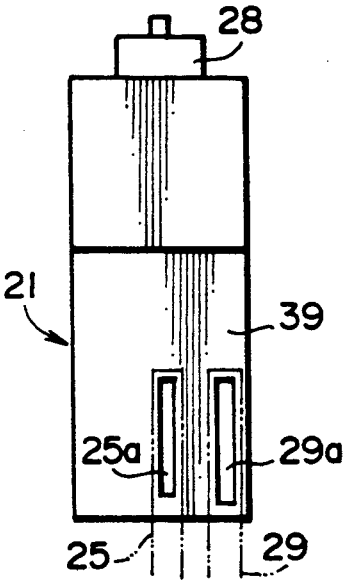
FIG. 2B is a side view of the coin discriminating means shown in FIG. 2A.
Figure 2A:
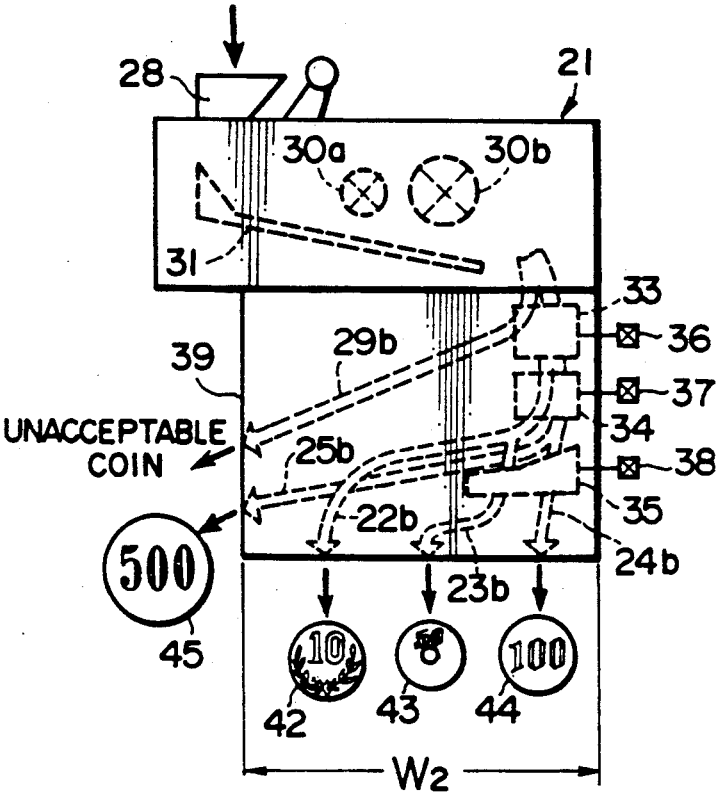
Figure 2C:
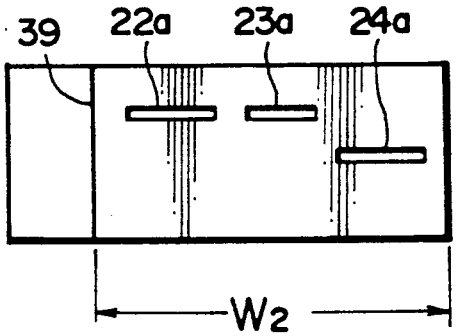
FIG. 2C is a bottom view of the coin discriminating means shown in FIG. 2A.

Referring to the drawings, FIGS. 1, 2A, 2B and 2C illustrate a coin handling apparatus according to a first embodiment of the present invention. Coin handling apparatus 20 comprises a coin discriminating device 21 disposed on the upper portion thereof and a plurality of coin retaining tubes 22, 23, 24 and 25 defining coin retaining means and auxiliary coin retaining tubes 26 and 27 on the lower portion thereof. In the coin discriminating device 21, a coin inlet 28 having a hopper-like shape is provided on the top portion thereof and three coin outlets 22*a*, 23*a* and 24*a* are formed on the bottom surface thereof as shown in FIG. 2C. A coin outlet 25*a* for five hundred unit coins, which are the largest coins handled by the apparatus, and a coin outlet 29*a* for unacceptable coins are formed in a horizontal line on a side surface 39 of the cash discriminating device 21 in this embodiment.

A coin chute 31 in the upper portion of the coin discriminating device 21 provides a coin path for coins deposited into the coin inlet 28. two coin validation coils 30*a* and 30*b* are disposed above the chute 31, as coin testing means. The coin validation coils 30*a* and 30*b* magnetically detect the material, shape, and so forth of a coin passing through the chute 31 and determine the authenticity and type of the coin.

Distributing gates 33, 34 and 35 are vertically arranged on a portion of the exist side of the chute 31, as a means for distributing the deposited coins to their destinations. Coin paths 22*b*, 23*b*, 24*b*, 25*b* and 29*b* extend from distributing gates 33, 34 and 35 to coin outlets 22*a*, 23*a*, 24*a* and 25*a* and unacceptable coin outlet 29*a*, respectively. The distributing gates 33, 34 and 35 are opened and closed by solenoids 36, 37 and 38, respectively. A coin which has passed through the coin validation coils 30*a* and 30*b* is led to one of coin outlets 22*a*, 23*a*, 24*a*, 25*a* and 29*a* through one of coin paths 22*b*, 23*b*, 24*b*, 25*b* and 29*b* according to the operation of distributing gates 33, 34 and 35. The combination of the opening and closing of the gates 33–35 is controlled by the signals from the coin validation coils.

Coin retaining tubes 22, 23, 24 and 25 have inside diameters corresponding substantially to the diameters of respective coins 42, 43, 44 and 45 to be accepted therein. Only coin retaining tube 25 for five hundred unit coins is disposed behind coin retaining tubes 22, 23 and 24 and the upper portion of the tube 25 is curved and connected to coin outlet 25*a* on the side surface 39 of coin discriminating device 21. Unacceptable coin outlet 29*a* is connected to a discharge path 29 for unacceptable coins and the discharging path is connected to an appropriate return opening (not shown) to the customer.

Figure 6:
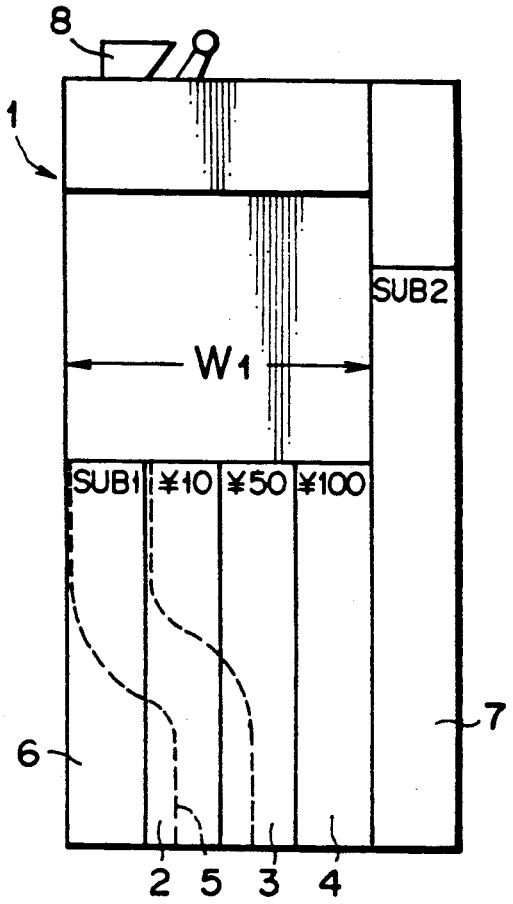
FIG. 6 PRIOR ART
FIG. 6 is a an elevational view of a conventional coin handling apparatus.
Figure 7A:
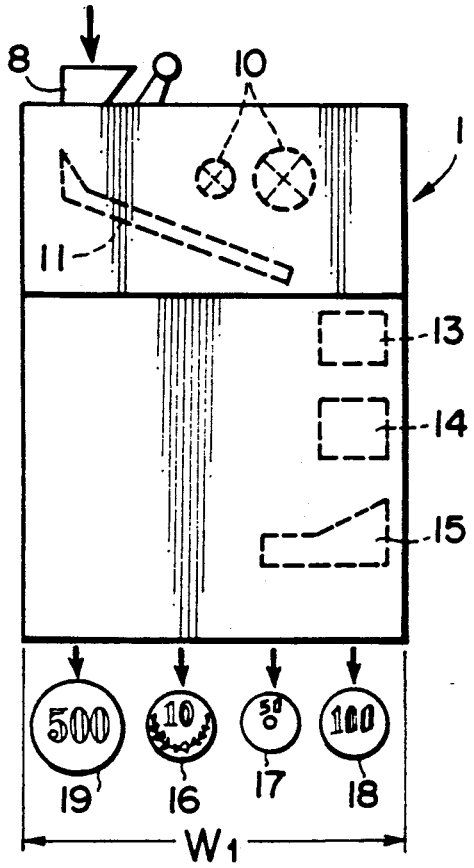
FIG. 7A PRIOR ART
FIG. 7A is an enlarged elevational view of the coin discriminating device of the apparatus shown in FIG. 6 showing the inside mechanism of the device.
Figure 7B:
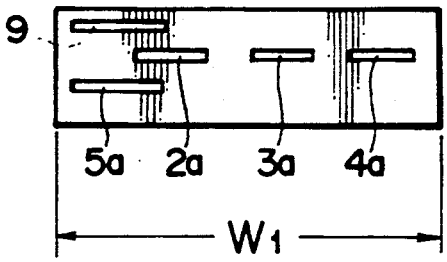
FIG. 7B PRIOR ART
FIG. 7B is a bottom view of the coin discriminating device of FIG. 7A.

Auxiliary coin retaining tubes 26 and 27 for retaining change therein are disposed on both sides of coin retaining tubes 22, 23 and 24. In contrast with the apparatus shown in FIG. 6, the left auxiliary coin retaining tube 26 has the same height as that of the right auxiliary coin retaining tube 27. Auxiliary coin retaining tubes 26 and 27 retain mainly ten unit coins, which in Japan for example are most frequently used as change as ten yen coins. Change falls down to a coventional change return mechanism 40 from the bottoms of the auxiliary coin retaining tubes in order.

In the above coin handling apparatus, a coin deposited into coin inlet 28 passes through coin chute 31, and the authenticity of the coin is tested and the type of the coin is determined by coin validation coils 30*a* and 30*b* during the coin's passage. The coin is then sent to one of five coin paths 22*b*, 23*b*, 24*b*, 25*b* and 29*b* by distributing gates 33, 34 and 35. An unacceptable coin, such as a metal slug or a foreign coin, is returned through coin path 29*b*, coin outlet 29*a* and discharging path 29. A ten unit coin 42 is led into coin retaining tube 22 through coin path 22b and coin outlet 22a. A fifty unit coin 43 is led into coin retaining tube 23 through coin path 23b and coin outlet 23a. A one hundred unit coin 44 is led into coin retaining tube 24 through coin path 24b and coin outlet 24a. A five hundred unit coin 45 is led into coin retaining tube 25 through coin path 25b and coin outlet 25a disposed on the side surface 39 of coin discriminating device 21.

The operation of distributing gates 33, 34 and 35 can be controlled, for example, as shown below in Table 1. In table 1, the mark "o" shows the "on" state of a solenoid, and the mark "x" shows the "off" state of the solenoid. A solenoid which has been turned on returns to its "off" state after a short period of time under the control of a timer.

TABLE 1

| | Unacceptable coin | 500 unit coin | 100 unit coin | 50 unit coin | 10 unit coin |
|---|---|---|---|---|---|
| Gate 33 | x | o | o | o | o |
| Gate 34 | x | x | x | o | o |
| Gate 35 | x | x | o | x | o |
| Coin path | 29b | 25b | 24b | 23b | 22b |
| Coin tube | 29 | 25 | 24 | 23 | 22 |

In this embodiment, since coin outlets 25a and 29a are formed on side surface 39 of coin discriminating device 21, the width $W_2$ of the coin discriminating device can be decreased, substantially by the size corresponding to the size to be occupied by the coin outlets on the bottom surface in the conventional device. Therefore, a space can be defined at a location facing the side surface 39 of coin discriminating device 21. In this embodiment, auxiliary coin retaining tube 26 is extended up into this space, and the capacity of the tube can thereby be increased. Of course, the number of coin outlets formed on the side surface 39 can be adjusted according to the particular requirements.

Figure 3:
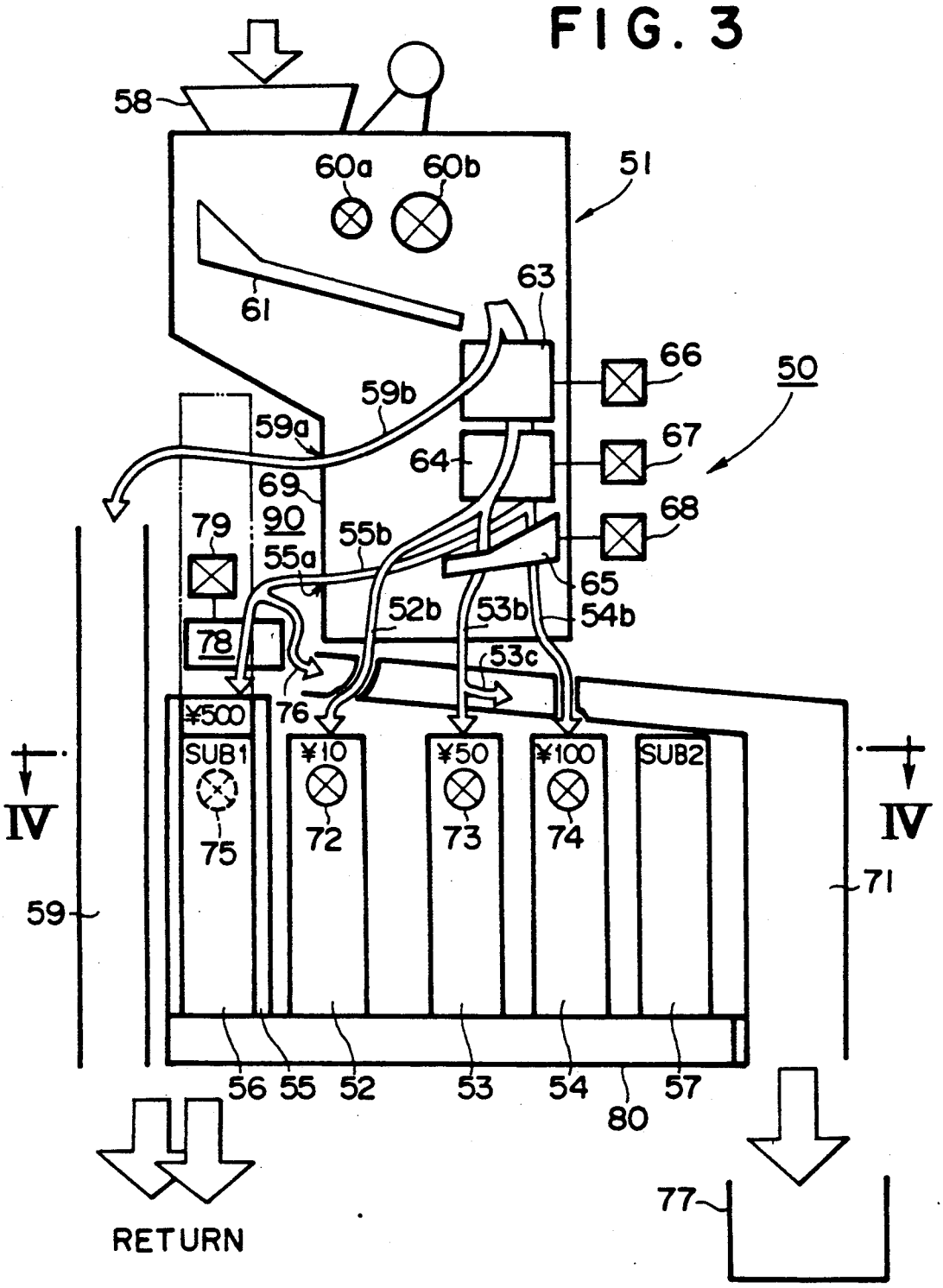
FIG. 3 is a schematic perspective elevational view of a coin handling apparatus according to a second embodiment of the present invention.
Figure 4:
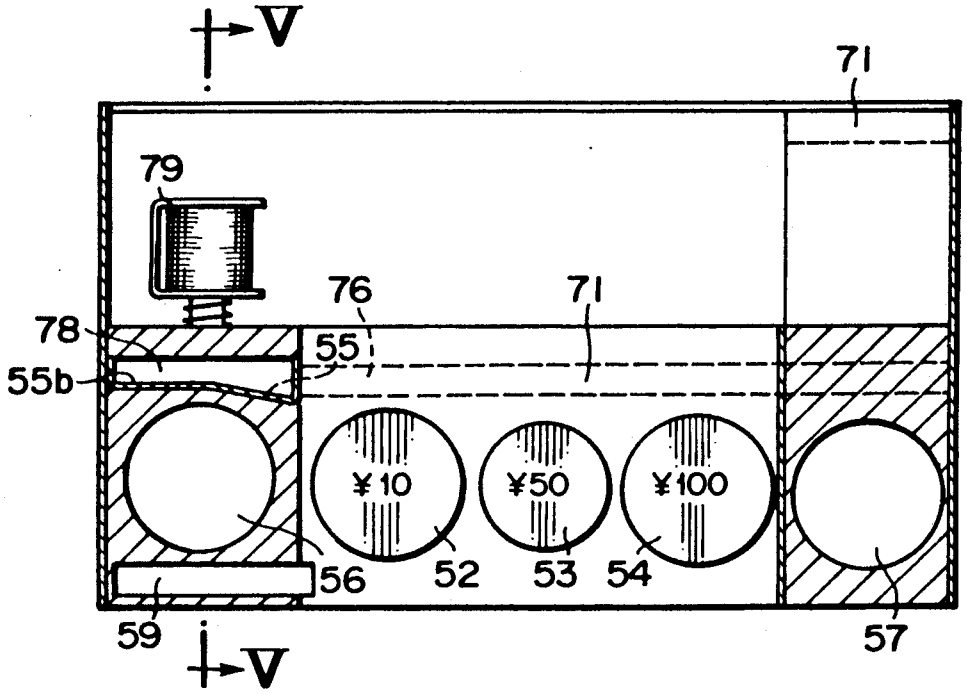
FIG. 4 is a sectional view of the apparatus of FIG. 3 taken along line IV—IV in FIG. 3.
Figure 5:
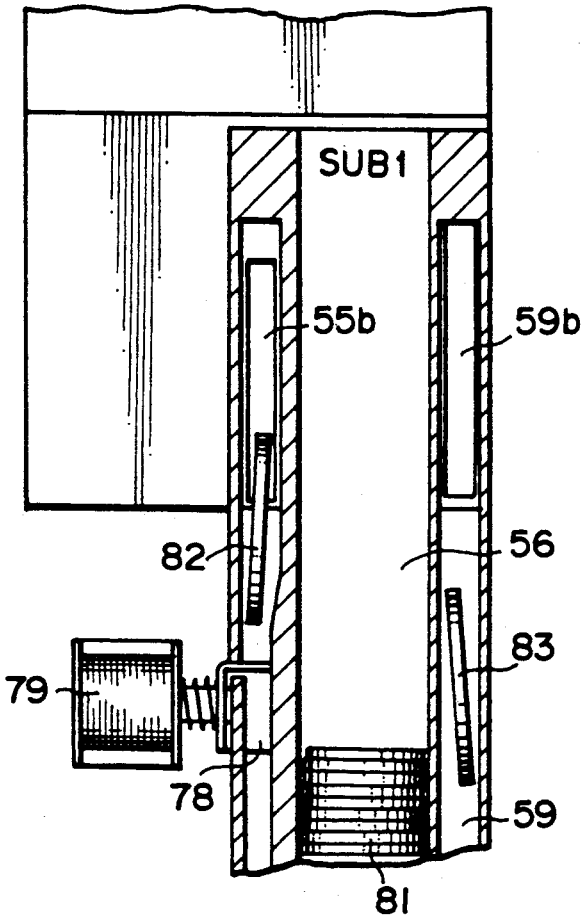
FIG. 5 is a sectional view of the apparatus of FIG. 4 taken along line V—V in FIG. 4.

FIGS. 3–5 illstrate a coin handling apparatus according to a second embodiment of the present invention. In this embodiment the coin handling apparatus 50 also has a coin discriminating device 51 on the upper portion thereof and a plurality of coin retaining tubes 52, 53, 54 and 55, auxiliary coin retaining tubes 56 and 57 and a discharging chute 59 for unacceptable coins on the lower portion thereof.

Coin inlet 58 having a hopper-like shape is provided on the to portion of the coin discriminating device 51. In the coin discriminating device 51, a coin chute 61 for deposited coins, coin validation coils 60a and 60b, three distributing 63, 64 and 65 and coin paths 52b, 53b, 54b, 55b and 59b extending from the distributing gates are provided.

The coin validation coils 60a and 60b magnetically detect the material, shape and so forth of the deposited coin passing through the chute 61 and determine the authenticity and the type of the coin. The distributing gates 63, 64 and 65 switch the coin paths 52b, 53b, 54b, 55b and 59b via the on-off operation of solenoids 66, 67 and 68 according to the type of the coin. In this embodiment, a coin outlet 55a of the coin path 55b for the largest coin and a coin outlet 59a of the coin path 59b for an unacceptable coin are disposed on the side surface 69 of the coin discriminating device 51.

Coin retaining tubes 52, 53, 54 and 55 are disposed corresponding to the coin outlets of the coin paths 52b, 53b, 54b and 55b, respectively, and retain, for example, ten unit coins, fifty unit coins, one hundred unit coins and five hundred unit coins, respectively. Auxiliary coin retaining tubes 56 and 57 are disposed on both sides of the coin retaining tubes 52, 53 and 54 and coins for change, mainly ten unit coins 81 (FIG. 5), are manually put therein. Chute 59 for unacceptable (rejected) coins is connected to the coin outlet 59b, and the lower portion of the chute is connected to a return opening (not shown).

Although all the coin retaining tubes are shown in a line in FIG. 3 to make it easy to understand the routes of each of the different coins, unacceptable coin chute 59, auxiliary coin retaining tube 56 and coin retaining tube 55 for five hundred unit coins are actually arranged in the thickness direction of the coin handling apparatus 50. Similarly auxiliary coin retaining tube 57 and a coin path 71 communicating with a cash box 77 are arranged in the same direction, as shown in FIGS. 4 and 5. The shape of the section of coin retaining tube 55 is almost the same as that of coin path 55b and the coin retaining tube can retain a five hundred unit coin 82 therein with the coin being substantially vertical. These arrangements and the structure of the tube can allow the apparatus to be made relatively small.

A conventional change return mechanism 80 is provided below coin retaining tubes 52, 53, 54 and 55 and auxiliary coin retaining tubes 56 and 57. The change return mechanism returns coins for change from the bottom of the tubes in order.

Overflow sensors 72, 73, 74 and 75 are attached on the upper portions of coin retaining tubes 52, 53, 54 and 55, respectively. Each overflow sensor detects whether the corresponding coin retaining tube is full. If it is full, the coin path to the coin retaining tube is switched to coin path 71 which communicates with cash box 77. Overflow path 76 for overflow coins diverges from coin path 55b for the largest coin (e.g., five hundred unit coins) and is connected to coin path 71 communicating with cash box 77. A distributing gate 78 for distributing the largest coin and the overflowed coin is provided at the divergent point, and a solenoid 79 for driving the gate is connected to the gate. In other words, coin path 55b from distributing gate 64 to distributing gate 78 constitutes a common coin path for the largeswt coins and for the overflow coins. The distributing gate 78 is disposed on the common path at a position outside of coin discriminating device 51.

Coin path 53c diverges from coin path 53b for fifty unit coins at a position above coin retaining tube 53. At the divergent point a distributing plate (not shown) having a hole or slit for a coin to be distributed is provided. The coin path 53c is connected to coin path 17 and a ten unit or one hundred unit coin misdirected to coin path 53b can be sent to the coin path 71 through the coin path 53c.

In coin handling apparatus 50, a coin deposited into coin inlet 58 is tested for its authenticity and type by coin validation coils 60a and 60b as it passes through coin chute 61. The coin is then sent to one of the coin paths 52b, 53b, 54b, 55b and 59b by distributing gates 63, 64 and 65 according to the signal from the coin validation coils. Distributing gate 78 is controlled according to the signals from overflow sensors 72, 73, 74 and 75. Table 2 which is set forth below shows the modes of operation of the distributing gates 63, 64, 65 and 12. In Table 2, the mark "o" designates the "on" state of a solenoid and the mark "x" similarly designates the "off" state of a solenoid. A solenoid which has been turned on returns to its "off" state after a short period of time under the control of a timer.

TABLE 2

| | Unacceptable coin | 500 unit coin | 100 unit coin | 50 unit coin | 10 unit coin | Overflow coin |
|---|---|---|---|---|---|---|
| Gate 63 | x | o | o | o | o | o |
| Gate 64 | x | x | x | o | o | x |
| Gate 65 | x | x | o | x | o | x |
| Gate 78 | x | o | x | x | x | x |
| Coin path | 59b | 55b | 54b | 53b | 52b | 55b, 76, 71 |
| Coin tube | 59 | 55 | 54 | 53 | 52 | Cash box |

As shown in Table 2, since no distributing gate operates when an unacceptable coin 83 (FIG. 5) is deposited, the coin is sent to coin path **59*b* and falls to a coin return opening through discharging chute 59. Acceptable coins are distributed as described below. When the deposited coin is a five hundred unit coin, distributing gates 63' and 78 operate and the coin is led into coin retaining tube 55 through coin path 55*b*. When the deposited coin is a one hundred unit coin, distributing gates 63 and 65 operate and the coin is led into coin retaining tube 54 through coin path 54*b*. When the deposited coin is a fifty unit coin, distributing gates 63 and 64 operate and the coin is led into coin retaining tube 53 through coin path 53*b*. When the deposited coin is a ten unit coin, distributing gates 63, 64 and 65 operate and the coin is led into coin retaining tube 52 through coin path 52*b***.

When coin retaining tube 52 is filled with ten unit coins, overflow sensor 72 detects this condition and coin path **52*b* is switched to coin path 55*b* as a coin path for overflow 10 unit coins. In this condition, only distributing gate 63 opens, and the next ten unit coin is sent to cash box 77 through coin paths 55*b*, 76 and 71. With other coin retaining tubes 53, 54 and 55**, the procedure is similar.

In the coin handling apparatus 50, since the coin path for overflow coins and coin paths **55*b* for the largest coins are formed as a single path, the number of coin paths to be formed in the coin discriminating device 51 is not increased even when an overflow path is provided in the device. Therefore, the coin discriminating device 51 can be smaller even through the device has the distributing function for overflow coins. Moreover, since the distributing gate 78 for distributing the overflow coins and the largest coins led along the common path 55*b* is disposed outside of coin discriminating device 51, the device can be made even smaller. As a result, a space 90, as illustrated in FIG. 3, can be defined at a location facing the side surface 69 of the device. The space 90 can be utilized to extend the auxiliary coin retaining tube 56 upwards as shown by the dotted line in FIG. 3, and the capacity of the tube 56 can thereby be increased. In this embodiment, distributing gate 78 and solenoid 79** therefor are disposed behind the extended tube.

Although several preferred embodiments of the present invention have been described herein in detail, it will be appreciated by those skilled in the art that various modifications and alterations can be made to them without materially departing from the novel teachings and advantages of this invention. Accordingly, it is to be understood that all such modifications and alterations are included within the scope of the invention as defined by the following claims.

What is claimed is:

1. A coin handling apparatus comprising:

coin discriminating means having side and bottom surfaces, coin testing means for determining the type of the deposited coins, distributing means for distributing the deposited coins according to their type as determined by said coin testing means and a plurality of coin outlets to one of which the coin distributed by said distributing means is guided, at least one of said plurality of coin outlets being disposed on said side surface of said coin discriminating means;

a plurality of coin retaining means positioned generally below said coin discriminating means, each of said coin retaining means communicating with a corresponding one of said coin outlets each of said coin discriminating means in accordance with the type of the accepted coin; and an overflow path extending substantially from said distributing means, the portion extending from said distributing means being common to a coin path for largest coins extending from said distributing means, said common path portion leading to a further distributing means for distributing the largest coins to a coin path communicating with the coin retaining means for the largest coin, and distributing the overflow coins to a cash box, said further distributing means being provided on said common path at a position outside of said coin discriminating means.

2. The coin handling apparatus of claim 1 wherein at least said common path extends through said coin outlet disposed on said side surface of said coin discriminating means.

3. The coin handling apparatus of claim 1 further comprising switching means for switching a coin path communicating with one of said coin retaining means to said overflow path which communicates with the cash box when the number of coins retained in said one of said coin retaining means reaches a predetermined number.

4. The coin handling apparatus of claim 1 further comprising a discharge path for unacceptable coins as determined by said coin testing means.

5. The coin handling apparatus of claim 1 further comprising at least one auxiliary coin retaining means which is not fed from said coin outlets.

6. The coin handling apparatus of claim 5 wherein at least one of said auxiliary coin retaining means extends upwards to the level of said side surface of said coin discriminating means.

7. The coin handling apparatus of claim 5 wherein at least one of said auxiliary coin retaining means and at least one of said coin retaining means are arranged in the thickness direction of said coin handling apparatus so as to overlap in the width direction of said coin handling apparatus.

8. The coin handling of claim 1 wherein said coin testing means is a coin validation coil.

9. The coin handling apparatus of claim 1 wherein said distributing means comprises a gate mechanism, which has a plurality of distributing gates for distributing coins which have passed through a position at which they were tested by said coin testing means to coin paths corresponding to the types of coins detected by said coin testing means, and solenoids driving said distributing gates.

10. The coin handling apparatus of claim 1 wherein at least one of said plurality of coin outlets is disposed on said bottom surface of said coin discriminating means.

11. A coin handling apparatus comprising:

coin discriminating means having a surface with a surface outlet, coin testing means for determining the type of the deposited coins, distributing means including a plurality of coin paths, said distributing means distributing the deposited coins according to their type as determined by said coin testing means, a plurality of coin outlets to which coins distributed by said distributing means are guided by way of said coin paths, and an overflow path at least substantially coincident with one said coin path and communicating with said surface outlet;

a plurality of coin retaining means positioned generally below said coin discriminating means, each of said coin retaining means communicating with a corresponding one of said coin outlets and accepting for retention therein deposited coins according to their type;

switching means for switching to said overflow path said coin path communicating with one of said coin retaining means which is retaining therein a predetermined number of coins;

a cash box for overflow coins; and gate means positioned outside of said discriminating means for distributing from said overflow path overflow coins to said cash box and non-overflow coins associated with said one said coin path to the associated coin retaining means.

12. The coin handling apparatus of claim 11 wherein said coin testing means comprises a coin validation coil.

13. The coin handling apparatus of claim 11 wherein said distributing means comprises a plurality of solenoid-driven distributing gates.

14. A coin handling apparatus comprising:

coin discriminating means having a side surface, a bottom surface, coin testing means for determining the type of the deposited coins, distributing means for distributing the deposited coins according to their type as determined by said coin testing means, a plurality of coin outlets to which coins distributed by said distributing means are guided, at least one of said coin outlets being on said side surface, at least one other of said coin outlets being on said bottom surface, an upper overhand portion extending out from and over said side surface and having an upper surface, and a coin inlet structure on said upper surface;

a plurality of coin retaining means positioned generally below said coin discriminating means, each of said coin retaining means communicating with a corresponding one of said coin outlets, and each of said coin retaining means accepting for retention therein deposited coins according to their type;

an auxiliary coin holding tube generally separate from said coin outlets, laterally acjacent said side surface, and positioned beneath said upper overhang portion;

a change return mechanism into which coins pass from said coin retaining means and said auxiliary coin holding tube; and a solenoid-actuated distributing gate communicable with said coin inlet structure through a coin path, positioned outside of said coin discriminating means and positioned below said upper overhang portion.

15. The coin handling apparatus of claim 14 wherein said coin distributing gate is positioned above said auxiliary coin holding tube.

* * * * *